US011274834B2

(12) United States Patent
Lee et al.

(10) Patent No.: US 11,274,834 B2
(45) Date of Patent: Mar. 15, 2022

(54) HEAT EXCHANGER AND AIR CONDITIONER HAVING THE SAME

(71) Applicant: Samsung Electronics Co., Ltd, Suwon-si (KR)

(72) Inventors: Sang mu Lee, Kanagawa (JP); Hyun young Kim, Kanagawa (JP); Akihiro Fujiwara, Kanagawa (JP)

(73) Assignee: Samsung Electronics Co., Ltd., Suwon-si (KR)

( * ) Notice: Subject to any disclaimer, the term of this patent is extended or adjusted under 35 U.S.C. 154(b) by 293 days.

(21) Appl. No.: 16/487,399

(22) PCT Filed: Feb. 20, 2018

(86) PCT No.: PCT/KR2018/002053
§ 371 (c)(1),
(2) Date: Aug. 20, 2019

(87) PCT Pub. No.: WO2018/151575
PCT Pub. Date: Aug. 23, 2018

(65) Prior Publication Data

US 2019/0376696 A1 Dec. 12, 2019

(30) Foreign Application Priority Data

Feb. 20, 2017 (JP) ..... JP2017-028643

(51) Int. Cl.
*F24F 1/00* (2019.01)
*F25B 39/00* (2006.01)
(Continued)

(52) U.S. Cl.
CPC ..... *F24F 1/00* (2013.01); *F25B 39/00* (2013.01); *F28F 1/32* (2013.01); *F28F 1/42* (2013.01);
(Continued)

(58) Field of Classification Search
CPC ..... F24F 1/00; F25B 39/00; F28F 1/32; F28F 1/42; F28F 2001/428; F28F 2275/125; B21D 19/12
See application file for complete search history.

(56) References Cited

U.S. PATENT DOCUMENTS 5,921,130 A * 7/1999 Yamada ..... B21D 53/02 72/358
9,279,624 B2 3/2016 Lee et al.
(Continued)

FOREIGN PATENT DOCUMENTS

JP 2001221587 A * 8/2001 ..... F28F 1/32
JP 3769594 B2 4/2006
(Continued)

OTHER PUBLICATIONS

JP-2001221587-A mt (Year: 2001).*
(Continued)

*Primary Examiner* — Gordon A Jones

(57) ABSTRACT

A heat exchanger according to an embodiment of the present disclosure and an air conditioner having the same include a heat transfer tube through which a refrigerant passes, a fin having a mounting hole in which the heat transfer tube is installed, and a fin collar extending from the mounting hole and being in contact with the heat transfer tube by the expansion of the heat transfer tube, wherein the fin collar includes a base portion provided adjacent to the fin and extending to be bent at a first curvature radius, and a distal end located on the opposite side of the base portion and extending to be bent at a second curvature radius smaller than the first curvature radius.

20 Claims, 9 Drawing Sheets

(51) Int. Cl.
*F28F 1/32* (2006.01)
*F28F 1/42* (2006.01)

(52) U.S. Cl.
CPC ... *F28F 2001/428* (2013.01); *F28F 2275/125* (2013.01)

(56) References Cited

U.S. PATENT DOCUMENTS

| | | | | |
|---|---|---|---|---|
| 2012/0285190 | A1* | 11/2012 | Lee | F28F 1/32 62/238.6 |
| 2013/0340986 | A1* | 12/2013 | Lee | F28F 1/42 165/181 |
| 2014/0151011 | A1 | 6/2014 | Kim et al. | |

FOREIGN PATENT DOCUMENTS

| | | | |
|---|---|---|---|
| JP | 2008-020166 | A | 1/2008 |
| JP | 2010-223578 | A | 10/2010 |
| JP | 5649715 | B2 | 1/2015 |
| KR | 10-2014-0070012 | A | 6/2014 |

OTHER PUBLICATIONS

International Search Report dated Jun. 20, 2018 in connection with International Patent Application No. PCT/KR2018/002053, 2 pages.
Written Opinion of the International Searching Authority dated Jun. 20, 2018 in connection with International Patent Application No. PCT/KR2018/002053, 9 pages.

* cited by examiner

HEAT EXCHANGER AND AIR CONDITIONER HAVING THE SAME

CROSS-REFERENCE TO RELATED APPLICATIONS

The present application is a 371 National Stage of International Application No. PCT/KR2018/002053 filed on Feb. 20, 2018, which claims the benefit of Japanese Patent Application No. 2017-028643 filed on Feb. 20, 2017, the disclosures of which are herein incorporated by reference in their entirety.

BACKGROUND

The present disclosure relates to a heat exchanger and an air conditioner having the same.

1. FIELD

A heat exchanger is for allowing air to exchange heat with a refrigerant passing through the inside thereof, and a fin-and-tube type heat exchanger, which is one type of the heat exchanger, includes heat transfer tubes through which the refrigerant passes, and plate-shaped fins through which the heat transfer tubes penetrate and provided to be orthogonal to the heat transfer tubes.

2. DESCRIPTION OF THE RELATED ART

The fin includes a fin collar extending from a portion adjacent to a mounting hole of the fin through which the heat transfer tube penetrates and contacting the heat transfer tube, so that heat may be more easily transferred from one of the heat transfer tube and the fin to the other through the fin collar.

The fin collar includes a base portion adjacent to the fin, a distal end portion positioned on the opposite side of the base portion, and an intermediate portion provided between the base portion and the distal portion, and the base portion and the distal end portion extend to be bent with respect to an axial direction of the heat transfer tube.

SUMMARY

The present disclosure is directed to providing a heat exchanger in which a fin collar comes into close contact with a heat transfer tube to improve the heat exchange ability and an air conditioner having the heat exchanger.

One aspect of the present disclosure provides an air conditioner including a heat exchanger to perform heat exchange between air and a refrigerant, wherein the heat exchanger includes a heat transfer tube through which the refrigerant passes, a fin having a mounting hole in which the heat transfer tube is installed, and a fin collar extending from the mounting hole and being in contact with the heat transfer tube by the expansion of the heat transfer tube, and the fin collar includes a base portion provided adjacent to the fin and extending to be bent at a first curvature radius, and a distal end located on the opposite side of the base portion and extending to be bent at a second curvature radius smaller than the first curvature radius.

The rate (r2/r1) of the second curvature radius r2 to the first curvature radius r1 is in the range to 0.65 to 0.95.

The thickness of the base portion is calculated with an average thickness ((T1+T2)/2) of a first thickness T1, which is the thickness of a first portion in the base portion adjacent to the fin, and a second thickness T2 which is the thickness of a second portion in the base portion far away from the fin.

The rate {(T1−T2)/2}/T0 of the average thickness ((T1+T2)/2) of the first thickness T1 and the second thickness T2 to the thickness T0 of the fin is 0.9 or more.

The base portion is gradually thinned from the first portion toward the second portion.

The heat transfer tube includes convex portions and concave portions formed alternately in a circumferential direction on an inner circumferential surface thereof.

N numbers of the convex portions and N numbers of the concave portions are provided in the circumferential directions on the inner circumferential surface of the heat transfer tube, the heat transfer tube has a minimum inner diameter Di determined by the most concave portion of the concave portions, and the ratio ((πDi/N)/Do) of the pitch (πDi/N) of the convex portions to the outer diameter Do of the heat transfer tube after tube expanding is in the range of 0.04 to 01.

The heat transfer tube includes convex portions and concave portions formed alternately in an axial direction on an inner circumferential surface thereof.

The convex portions extend obliquely with respect to the axial direction of the heat transfer tube.

The ratio (L/Do) of a lead angle formed by the extending direction of the convex portions and the axial direction of the heat transfer tube to the outer diameter Do of the heat transfer tube is in the range of 3.3 deg./m to 5.5 deg./m.

Another aspect of the present disclosure provides a heat exchanger including a heat transfer tube through which a refrigerant passes, a fin having a mounting hole in which the heat transfer tube is installed, and a fin collar extending from the mounting hole and being in contact with the heat transfer tube by the expansion of the heat transfer tube, wherein the fin collar includes a base portion provided adjacent to the fin and extending to be bent at a first curvature radius, and a distal end located on the opposite side of the base portion and extending to be bent at a second curvature radius smaller than the first curvature radius.

Another aspect of the present disclosure provides a heat exchanger and an air conditioner including a heat transfer tube through which a refrigerant passes, wherein the heat transfer tube includes N numbers of convex portions and N numbers of the concave portions formed alternately in the circumferential directions on the inner circumferential surface thereof, the heat transfer tube has a minimum inner diameter Di determined by the most concave portion of the concave portions, and the ratio ((πDi/N)/Do) of the pitch (πDi/N) of the convex portions to the outer diameter Do of the heat transfer tube after tube expanding is in the range of 0.04 to 01.

Another aspect of the present disclosure provides a heat exchanger and an air conditioner including a heat transfer tube through which a refrigerant passes, wherein the heat transfer tube includes convex portions and concave portions formed alternately in an axial direction on an inner circumferential surface thereof and extending obliquely with respect to the axial direction of the heat transfer tube, and the ratio (L/Do) of a lead angle formed by the extending direction of the convex portions and the axial direction of the heat transfer tube to the outer diameter Do of the heat transfer tube is in the range of 3.3 deg./m to 5.5 deg./m.

A heat exchanger and an air conditioner having the same according to one aspect of the present disclosure reduce the contact thermal resistance between a fin collar and a heat transfer tube, thereby improving the heat exchange ability because a base portion of the fin collar presses the heat transfer tube, thereby improving the adhesion between the fin collar and the heat transfer tube.

DETAILED DESCRIPTION

Figure 1:
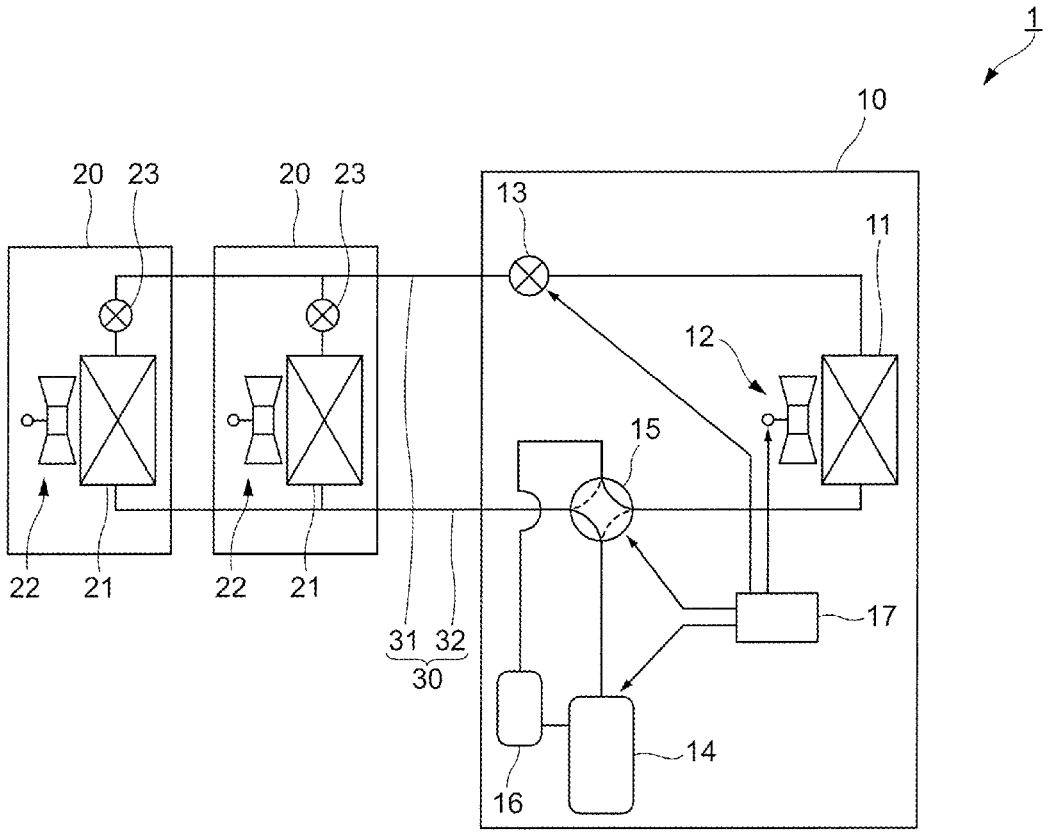
FIG. 1 is a schematic configuration diagram of an air conditioner according to an embodiment of the present disclosure.

The embodiments described in the present specification and the configurations shown in the drawings are only examples of preferred embodiments of the present disclosure, and various modifications may be made at the time of filing of the present disclosure to replace the embodiments and drawings of the present specification.

Like reference numbers or signs in the respective drawings of the present specification represent parts or components that perform substantially the same functions.

The terms used in the present specification are for the purpose of describing the embodiments and are not intended to restrict and/or to limit the present disclosure. For example, the singular expressions herein may include plural expressions, unless the context clearly dictates otherwise. Also, the terms "comprises" and "has" are intended to indicate that there are features, numbers, steps, operations, elements, parts, or combinations thereof described in the specification, and do not exclude the presence or addition of one or more other features, numbers, steps, operations, elements, parts, or combinations thereof.

It will be understood that, although the terms first, second, etc. may be used herein to describe various components, these components should not be limited by these terms. These terms are only used to distinguish one component from another. For example, without departing from the scope of the present disclosure, the first component may be referred to as a second component, and similarly, the second component may also be referred to as a first component. The term "and/or" includes any combination of a plurality of related items or any one of a plurality of related items.

The terms "front end," "rear end," "upper portion," "lower portion," "upper end" and "lower end" used in the following description are defined with reference to the drawings, and the shape and position of each component are not limited by these terms. Hereinafter, embodiments of the present disclosure will be described in detail with reference to the accompanying drawings.

An air conditioner according to the present disclosure will be described in detail below with reference to a drawing.

FIG. 1, which is a diagram illustrating the configuration of an air conditioner 1, shows a case where the air conditioner 1 performs a heating operation.

As illustrated in FIG. 1, the air conditioner 1 includes an outdoor unit 10 disposed in an outdoor space, a plurality of indoor units 20 each installed in indoor spaces, and refrigerant pipes 30 connecting the outdoor unit 10 and the indoor units 20 to allow a refrigerant to circulate through the outdoor unit 10 and the indoor units 20.

Although FIG. 1 illustrates the air conditioner 1 in which two of the indoor units 20 are connected to one of the outdoor unit 10, this is only an example. That is, one of the indoor unit 20, or three or more of the indoor units 20 may be connected to one of the outdoor unit 10.

The outdoor unit 10 includes an outdoor heat exchanger 11 for performing heat exchange with outdoor air, an outdoor fan 12 for blowing outdoor air to the outdoor heat exchanger 11 to allow the outdoor air to heat-exchange with the refrigerant flowing in the outdoor heat exchanger 11, and an outdoor expansion valve 13 for decompressing and expanding the refrigerant.

The outdoor unit 10 also includes a compressor 14 for compressing the refrigerant, a four-way valve 15 for guiding the refrigerant discharged from the compressor 14 to one of the outdoor heat exchanger 11 and an indoor heat exchanger 21, which will be described later, and an accumulator 16 connected to a suction side of the compressor 14 to separate liquid refrigerant from the refrigerant that is sucked into the compressor 14.

The compressor 14, the four-way valve 15, the outdoor heat exchanger 11, and the accumulator 16 are connected to each other through the refrigerant pipes to receive the refrigerant.

The four-way valve 15 is connected to the outdoor heat exchanger 11, the accumulator 16, and the compressor 14 through the refrigerant pipes. The outdoor heat exchanger 11 and the outdoor expansion valve 13 are connected through the refrigerant pipe, and the accumulator 16 and the compressor 14 are also connected through the refrigerant pipes 30.

The outdoor unit 10 also includes a controller 17 for controlling the operation of the outdoor fan 12, the outdoor expansion valve 13, the compressor 14 and the four-way valve 15. The controller 17 may be implemented by a microcomputer or a microprocessor.

The indoor unit 20 includes an indoor heat exchanger 21 for performing heat exchange with indoor air, an indoor fan 22 for blowing indoor air to the indoor heat exchanger 21 to allow the indoor air to heat-exchange with the refrigerant flowing in the indoor heat exchanger 21, and an indoor expansion valve 23 for decompressing and expanding the refrigerant.

The refrigerant pipes 30 include a liquid refrigerant pipe 31 through which liquid refrigerant passes, and a gas refrigerant pipe 32 through which gas refrigerant passes. The liquid refrigerant pipe 31 allows the refrigerant to be transferred between the indoor expansion valve 23 and the outdoor expansion valve 13. The gas refrigerant pipe 32 allows the refrigerant to be transferred between the four-way valve 15 and a gas side of the indoor heat exchanger 21.

Figure 2:
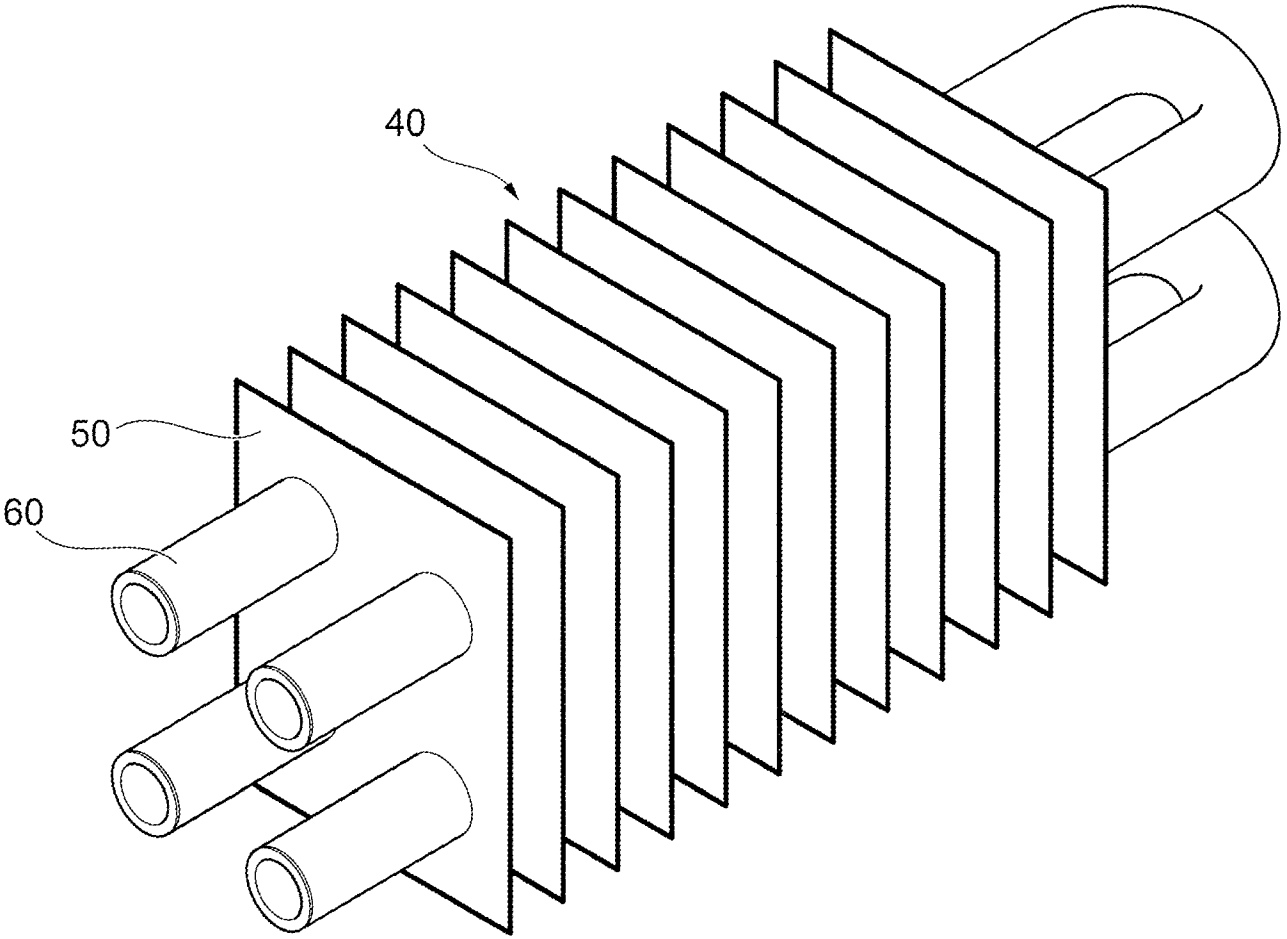
FIG. 2 is a perspective view of a heat exchanger according to an embodiment of the present disclosure.

FIG. 2 is a perspective view of a heat exchanger 40 applied to the air conditioner 1 of the present disclosure, and the heat exchanger 40 corresponds to at least one of the outdoor heat exchanger 11 and the indoor heat exchanger 21 illustrated in FIG. 1.

The heat exchanger 40 is a fin-and-tube type heat exchanger and includes a plurality of heat exchange fins 50 and heat transfer tubes 60.

The plurality of fins 50 is each formed in a plate shape orthogonal to an axial direction of the heat transfer tubes 60, and is spaced apart from each other in parallel. Further, the fins 50 include mounting holes (not numbered) for allowing the heat transfer tubes 60 to penetrate.

The heat transfer tubes 60 are connected to the refrigerant pipes 30 in FIG. 1, and the refrigerant passes through the inside of the heat transfer tubes 60. One of HC single refrigerant, mixed refrigerant including HC, R32, R410A, R407C, and carbon dioxide may be used as the refrigerant.

Thus, the heat exchanger 40 has a wider contact area with the air passing through the heat exchanger 40 through the fins 50, so that heat exchange between the refrigerant passing through the inside of the heat transfer tubes 60 and the air passing through the heat exchanger 40 is performed more efficiently.

Figure 3:
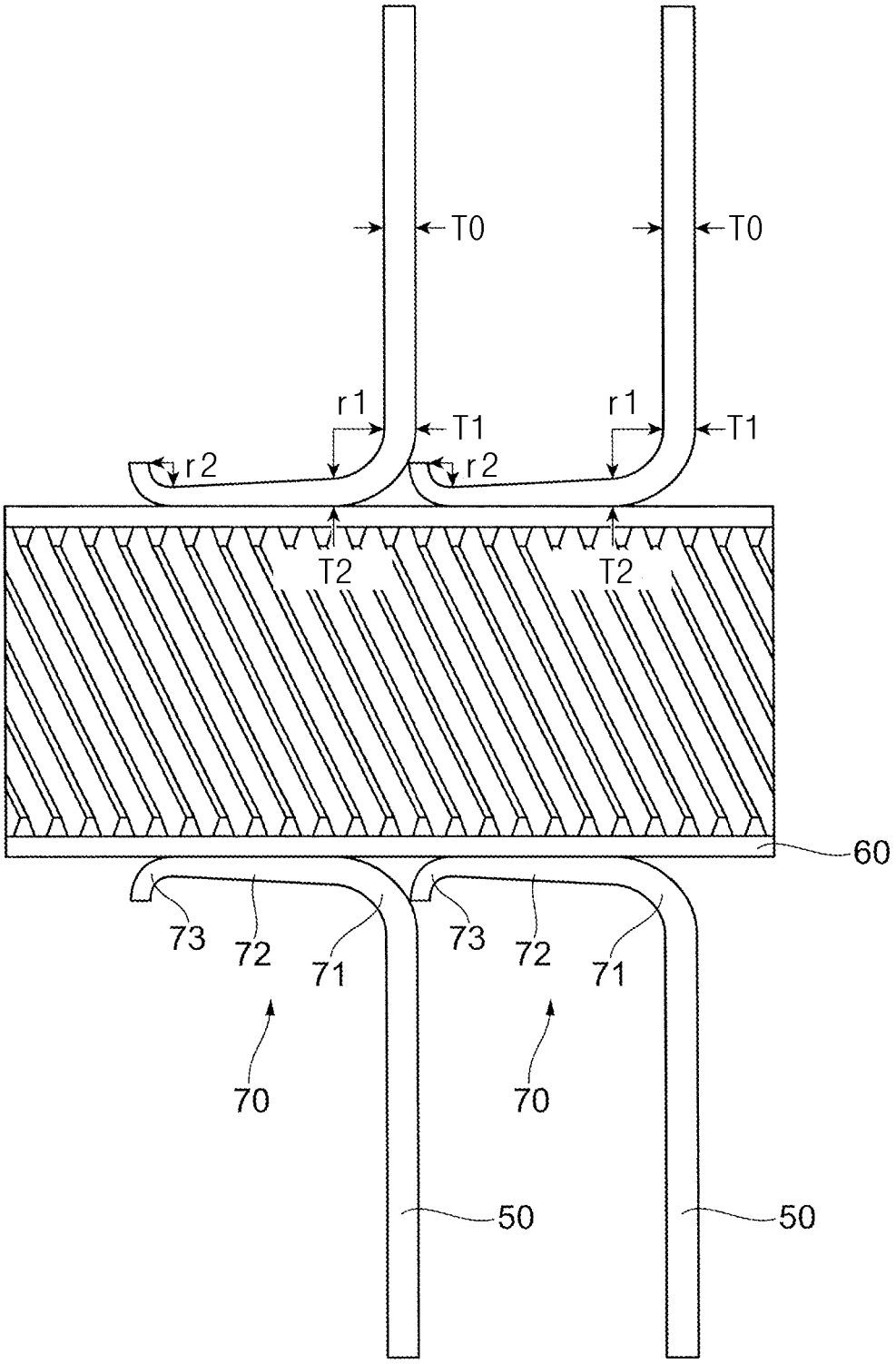
FIG. 3 is a cross-sectional view illustrating contact portions between fins and a heat transfer tube applied to a heat exchanger according to a first embodiment of the present disclosure.

FIG. 3 is a cross-sectional view illustrating contact portions between the fins 50 and the heat transfer tubes 60 of the heat exchanger 40 according to a first embodiment of the present disclosure.

As illustrated in the drawing, the fins 50 each include a fin collar 70 integrally extending from the mounting hole. The heat exchanger 40 is a fin-and-tube type heat exchanger that is made by installing the heat transfer tubes 60 on the inside of the fin collars 70 integrally extending from portions adjacent to the mounting holes of the fins 50 and then expanding the heat transfer tubes 60 so that the fin collars 70 come into contact with the heat transfer tubes 60.

The fin collar 70 includes a base portion 71, an intermediate portion 72, and a distal end portion 73.

The base portion 71 is an end portion of the fin collar 70 adjacent the fin 50 and extends to be bent in the axial direction from a radial direction of the heat transfer tube 60.

The intermediate portion 72 is a portion formed between the base portion 71 and the distal end portion 73 in the fin collar 70 to extend parallel to the heat transfer tube 60.

The distal end portion 73 is an end portion of the fin collar 70 located on the opposite side of the base portion 71 and extends to be bent in the radial direction from the axial direction of the heat transfer tube 60.

In this embodiment, the fin collar 70 is formed such that a second curvature radius which is the radius of curvature of the distal end portion 73 after tube expanding is smaller than a first curvature radius which is the radius of curvature of the base portion 71 after tube expanding. That is, as illustrated in FIG. 3, when the first curvature radius which is the radius of curvature of the base portion 71 after tube expanding is denoted by r1 and the second curvature radius which is the radius of curvature of the distal end portion 73 after tube expanding is denoted by r2, an inequality r2/r1<1 is established.

Figure 4:
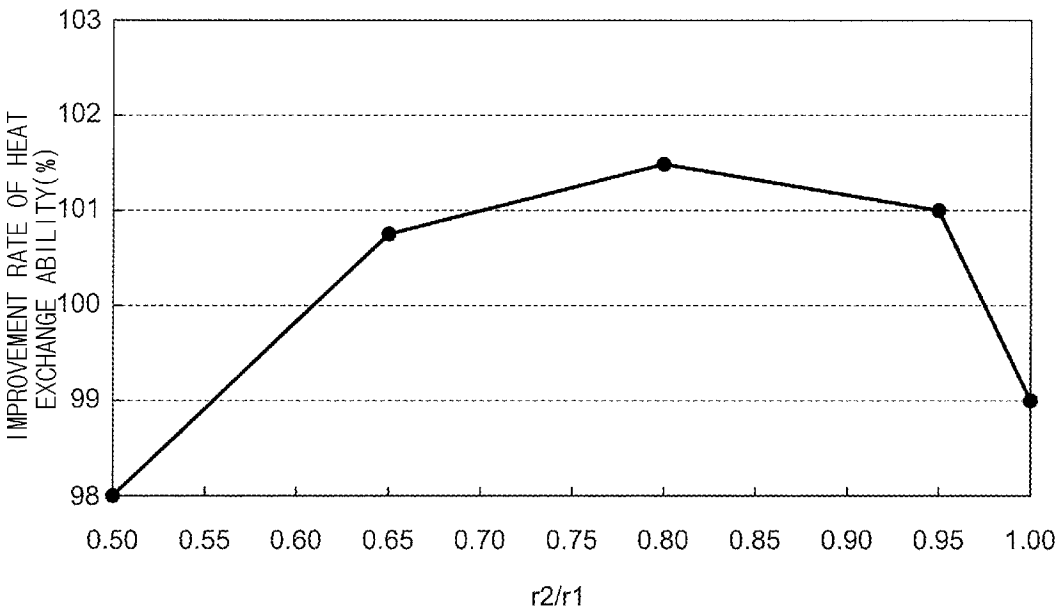
FIG. 4 is a graph illustrating the improvement rate of the heat exchange ability of the heat exchanger according to the ratio of the radius of curvature of a distal end portion after tube expanding to the radius of curvature of a base portion after tube expanding.

FIG. 4 is a graph illustrating the relationship between the ratio (r2/r1) of the second curvature radius r2, which is the radius of curvature of the distal end portion 73 after tube expanding, to the first curvature radius r1 which is the radius of curvature of the base portion 71 after tube expanding and the improvement rate of the heat exchange ability of the heat exchanger 40.

In the graph of FIG. 4, the heat exchange ability of the heat exchanger 40 having a general specification is set to be 100%, and when r2/r1 is in the range of 0.65 to 0.95, the improvement rate of the heat exchange ability exceeds 100%. Thus, it is appropriate that r2/r1 is a value in the range of 0.65 to 0.95.

This is because when the first curvature radius r1, which is the radius of curvature of the base portion 71 after tube expanding, increases, the base portion 71 presses the heat transfer tube 60 to improve the adhesion between the fin collar 70 and the heat transfer tube 60, thereby reducing the contact thermal resistance.

Although the contact length between the heat transfer tube 60 and the fin collar 70 increases to improve the heat exchanging ability when the second curvature radius r2, which is the radius of curvature of the distal end portion 73 after tube expanding, decreases, if the second curvature radius r2, which is the radius of curvature of the distal end portion 73 after tube expanding, is excessively small, the distal end portion 73 may come into contact with the neighboring base portion 71 to weaken the force of the distal portion 73 pressing the heat transfer tube 60, and in this case, the adhesion between the fin collar 70 and the heat transfer tube 60 may not be maintained.

Therefore, by setting r2/r1 to a value in the range of 0.65 to 0.95, the contact thermal resistance may be reduced while maintaining the adhesion between the heat transfer tube 60 and the fin collar 70.

Also, because pin collar 70 includes the bent distal end portion 73, a spacing may be maintained between the adjacent fins 50 when the fins 50 are installed to the heat transfer tube 60, and the pin collar 70 may be prevented from entering between the neighboring pin collar 70 and the heat transfer tube 60.

In the first embodiment, the thickness of the base portion 71 of the pin collar 70 is formed to be thinner than the thickness of the fin 50.

In the present embodiment, it is appropriate that the thickness of the base portion 71 is calculated with an average thickness of the thickness of a first portion in the base portion 71 adjacent to the fin 50 and the thickness of a second portion in the base portion 71 far away from the fin 50. That is, as illustrated in FIG. 3, when the thickness of the fin 50 is denoted by T0, the thickness of the first portion of the base portion 71 is denoted by T1, and the thickness of the second portion of the base portion 71 is denoted by T2, an inequality {(T1+T2)/2}/T0<1 is established.

Figure 5:
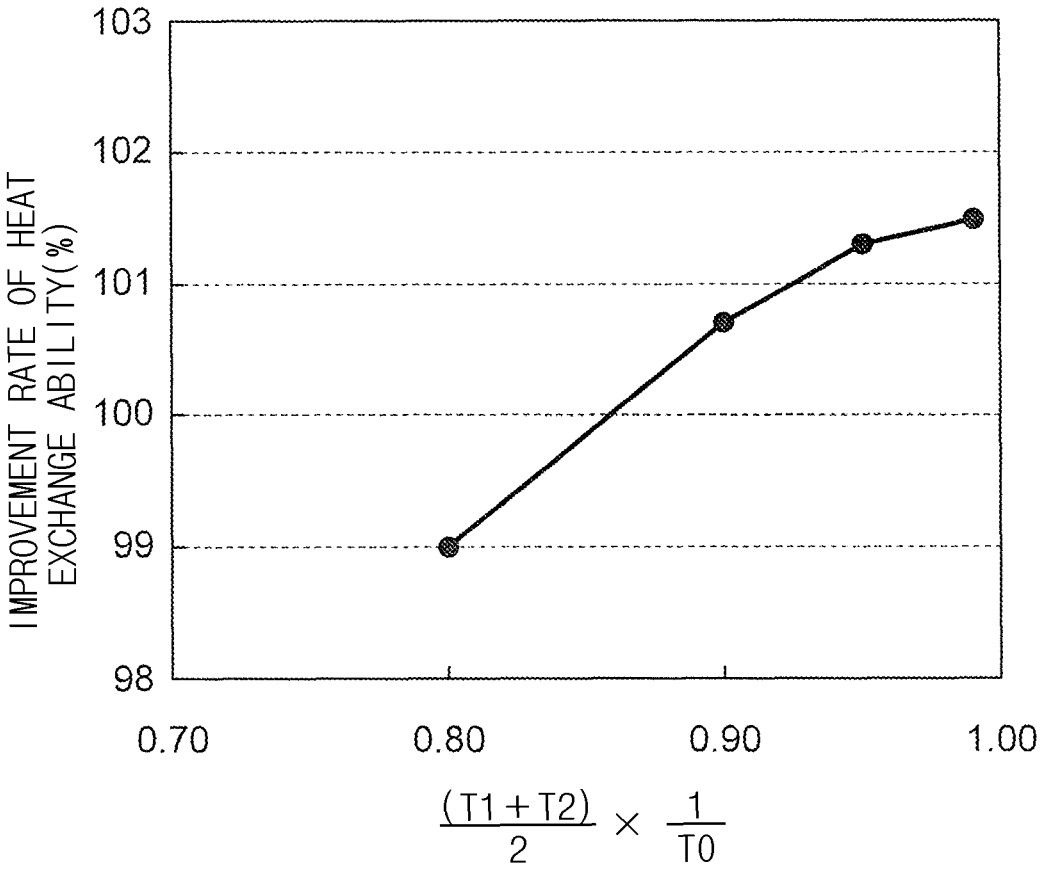
FIG. 5 is a graph illustrating the improvement rate of the heat exchange ability of the heat exchanger according to the ratio of an average thickness of the base portion to a thickness of the fin.

FIG. 5 is a graph illustrating the relationship between the ratio of the average thickness ((T1+T2)/2) of the base portion 71 to the thickness T0 of the fin 50 and the improvement rate of the heat exchange ability of the heat exchanger 40. In this graph, the heat exchange ability of the heat exchanger 40 having a general specification is set to be 100%.

As illustrated in the drawing, {(T1+T2)/2}/T0 is 0.9 or more, and the improvement rate of the heat exchange ability exceeds 100%. Thus, it is appropriate that {(T1+T2)/2}T0 is a value of 0.9 or more. This is because although it is appropriate for machining that the thickness of the base portion 71 is thinner than the thickness of the fin 50, when the thickness of the base portion 71 is excessively thin, the pressing force of the base portion 71 against the heat transfer tube 60 is weakened so that the adhesion between the fin collar 70 and the heat transfer tube 60 is not maintained.

The base portion 71 may be formed to be gradually thinner from the first portion adjacent to the fin 50 toward the second portion far away from the fin 50.

As such, in the first embodiment of the present disclosure, the fin collar 70 is formed such that the second curvature radius r2 of the distal end portion 73 after tube expanding is smaller than the first curvature radius r1 of the base portion 71 after tube expanding. With this configuration, the contact thermal resistance may be reduced to improve the heat exchange ability by improving the adhesion between the fin collar 70 and the heat transfer tube 60 by the force of the base portion 71 of the fin collar 70 pressing the heat transfer tube 60.

Also, in the first embodiment of the present disclosure, the thickness of the base portion 71 of the fin collar 70 is made thinner than the thickness of the fin 50 and $\{(T1+T2)/2\}/T0$ is set to 0.9 or more, so that the problem that may occur when the thickness of the base portion 71 is excessively thin may be overcome and the heat exchange ability of the fin collar 70 may be improved by reducing the contact thermal resistance.

Figure 6:
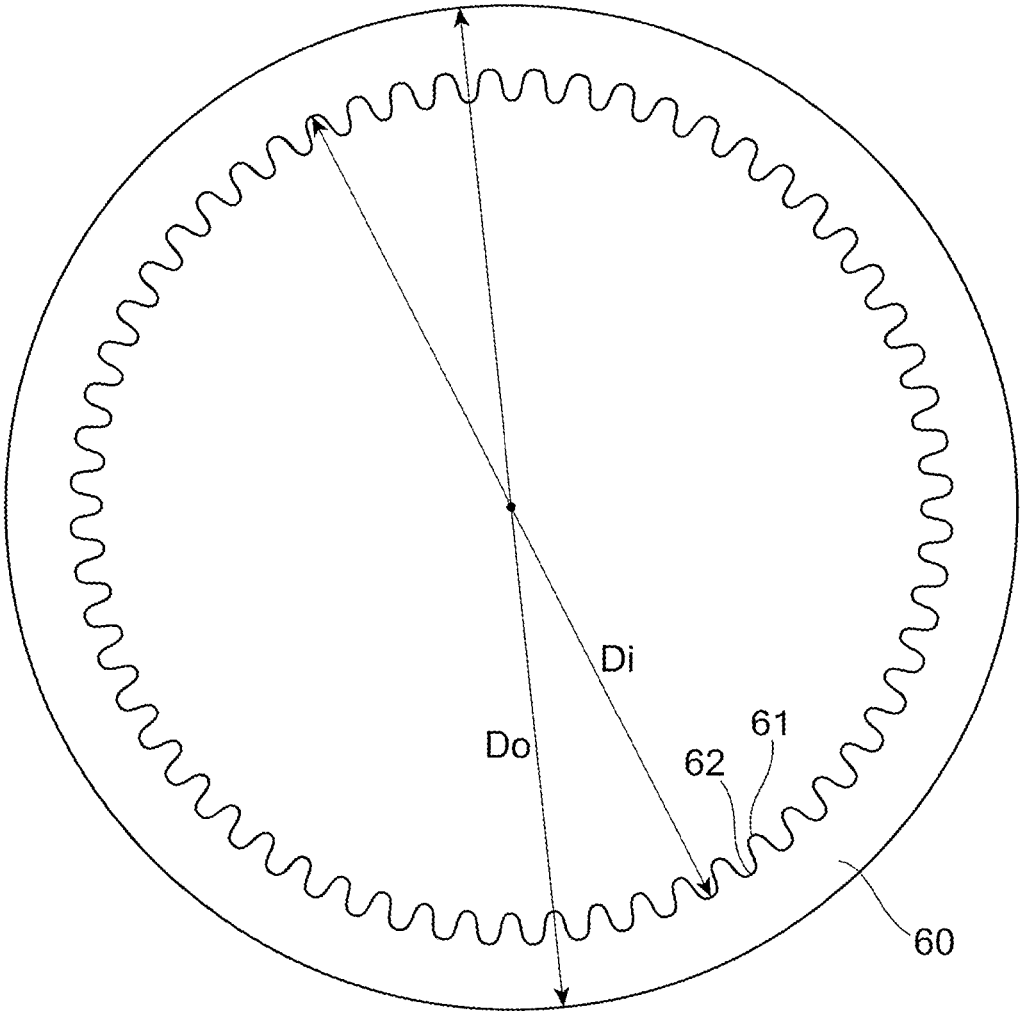
FIG. 6 is a cross-sectional view of a heat transfer tube applied to a heat exchanger according to a second embodiment of the present disclosure.

FIG. 6 is a cross-sectional view of the heat transfer tube 60 included in the heat exchanger 40 according to a second embodiment of the present disclosure.

The heat transfer tube 60 includes convex portions 61 and concave portions 62 alternately provided along the inner circumferential surface thereof. Hereinafter the number of the convex portions 61 and the concave portions 62 formed in the circumferential direction on the inner circumferential surface of the heat transfer tube 60 is denoted by N.

When the pitch of the convex portions 61 in the heat transfer tube 60 is too short, the heat transfer performance inside the heat transfer tube 60 is reduced because the refrigerant remains in the concave portions 62, and as a result, the heat exchanging ability of the heat exchanger 40 is lowered. Conversely, when the pitch of the convex portions 61 in the heat transfer tube 60 is too long, the convex portions 61 are collapsed to lower the heat transfer performance inside the heat transfer tube 60 or to increase the contact thermal resistance between the heat transfer tube 60 and the fin collar 70, thereby lowering the heat exchange ability.

Accordingly, the convex portions 61 of the heat transfer tube 60 applied to the heat exchanger 40 according to the second embodiment of the present disclosure are formed such that the ratio of the pitch of the convex portions 61 to the outer diameter of the heat transfer tube 60 after tube expanding is set to be a value within a set range.

That is, as illustrated in FIG. 6, when the minimum inner diameter of the heat transfer tube 60 is denoted by Di and the outside diameter of the heat transfer tube 60 after tube expanding is denoted by Do, the rate of the pitch ($\pi Di/N$) of the convex portions 61 to the outside diameter Do of the heat transfer tube 60 after tube expanding, that is, $(\pi Di/N)/Do$ is set to be in a predetermined range.

The minimum inner diameter Di of the heat transfer pipe 60 indicates the inner diameter of the recessed portion 62 having the maximum inner diameter (That is, the inside diameter of the concave portion in the most concave position among the concave portions 62) among N numbers of the recessed portions 62 as the minimum inner diameter Di. One of the inner diameter of concave portions 62 may be used as the minimum inner diameter Di when the thickness of the heat transfer tube 60 is constant, but generally, since the thickness of the heat transfer tube 60 is not constant, the inner diameter of the concave portion 62 having the maximum inner diameter among the N concave portions 62 in FIG. 6 is used as the minimum inner diameter Di.

Figure 7:
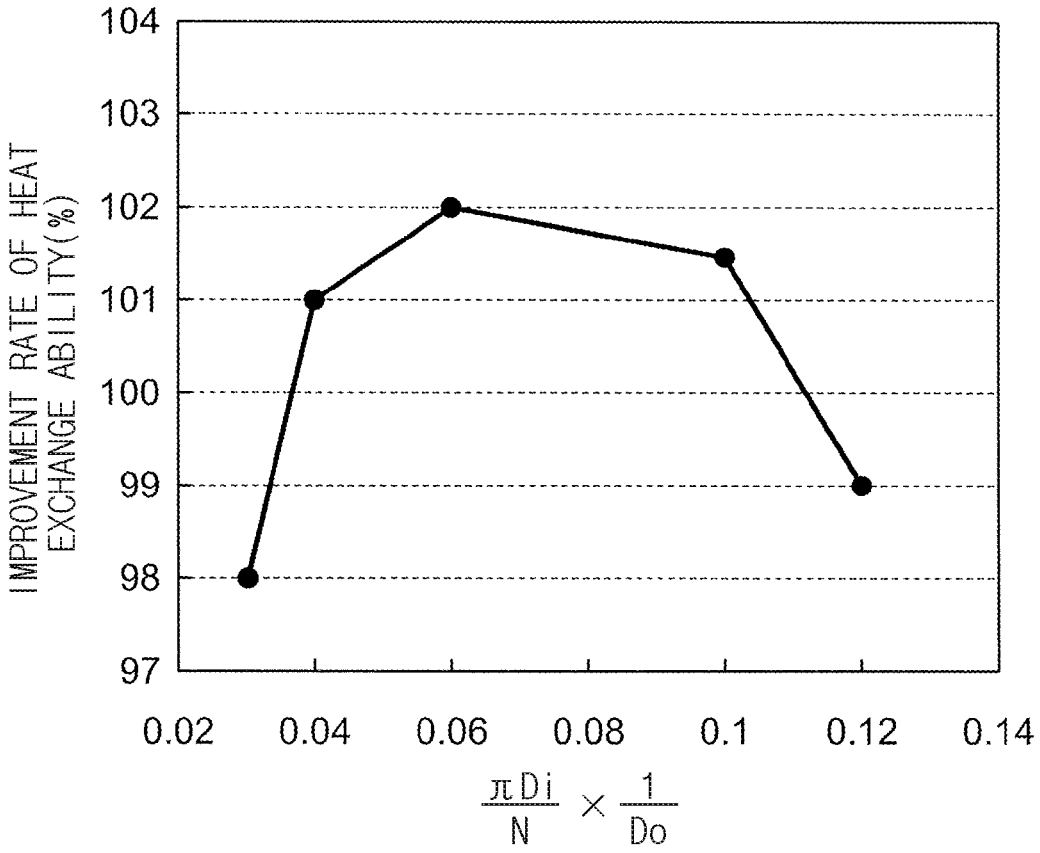
FIG. 7 is a graph illustrating the improvement rate of the heat exchange ability of the heat exchanger according to the ratio of the pitch of convex portions on an inner circumferential surface of the heat transfer tube to an outer diameter of the heat transfer tube after tube expanding.

FIG. 7 is a graph illustrating the relationship between the ratio $((\pi Di/N)/Do)$ of the pitch ($\pi Di/N$) of the convex portions 61 formed on the inner circumferential surface of the heat transfer tube 60 to the outer diameter Do of the heat transfer tube 60 after tube expanding and the improvement rate of the heat exchange ability of the heat exchanger 40. In this graph too, the heat exchange ability of the heat exchanger 40 having a general specification is set to be 100%.

As illustrated in FIG. 7, when $(\pi Di/N)/Do$ is in the range of 0.04 to 0.1, the improvement rate of the heat exchange ability exceeds 100%. Thus, it is appropriate that $(\pi Di/N)/Do$ is a value in the range of 0.04 to 01.

As such, in the second embodiment, the ratio of the pitch of the convex portions 61 formed on the inner circumferential surface of the heat transfer tube 60 to the outer diameter of the heat transfer tube 60 after tube expanding is set to a value within a predetermined range. Accordingly, a decrease in heat exchange ability due to a decrease in heat transfer performance inside the heat transfer tube 60 or due to an increase in the contact thermal resistance between the heat transfer tube 60 and the fin collar 70 may be suppressed.

Figure 8:
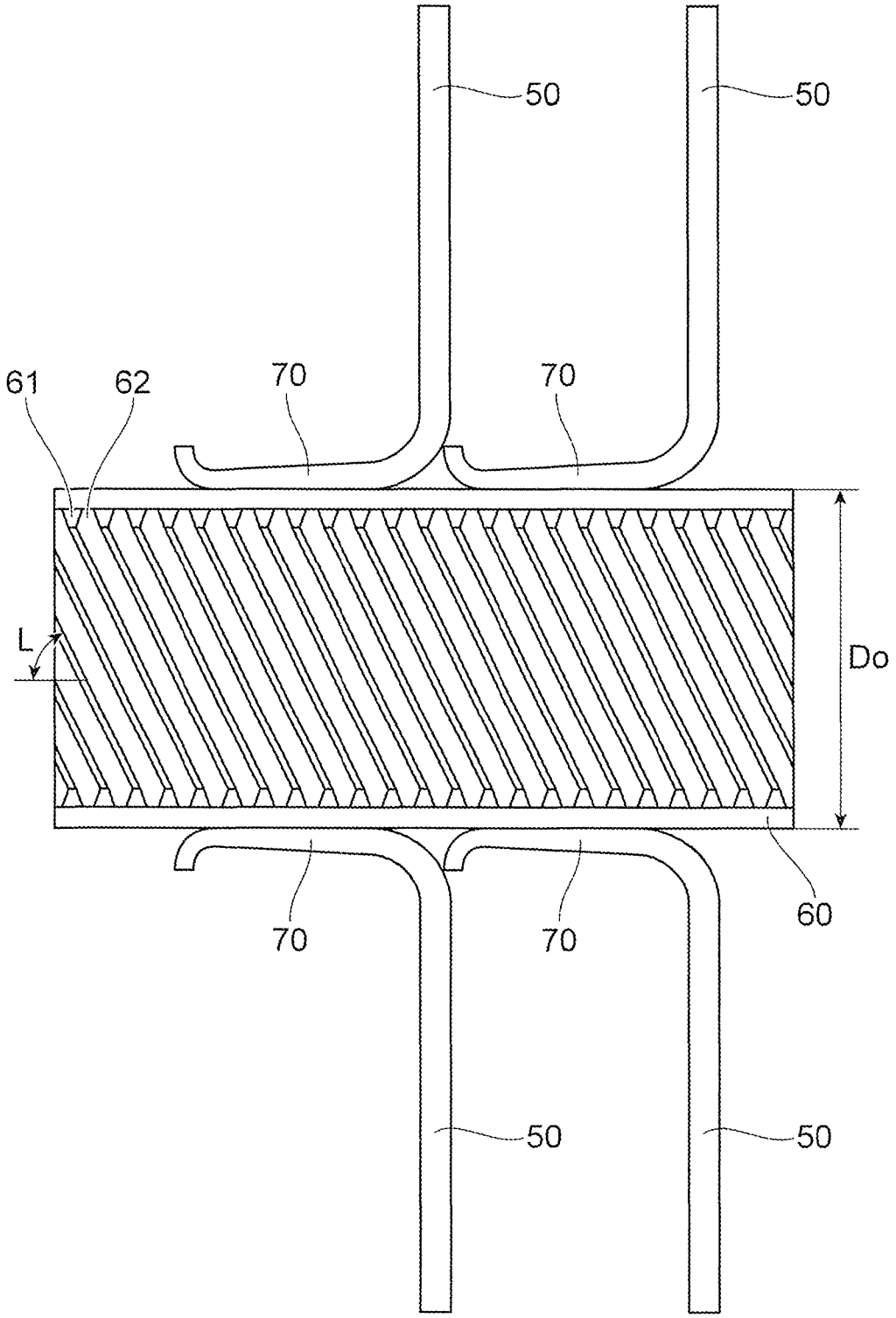
FIG. 8 is a cross-sectional view illustrating contact portions between fins and a heat transfer tube applied to a heat exchanger according to a third embodiment of the present disclosure.

FIG. 8 is a cross-sectional view illustrating contact portions between the fins 50 and the heat transfer tube 60 applied to the heat exchanger 40 according to a third embodiment of the present disclosure.

As illustrated in the drawing, the heat transfer tube 60 includes convex portions 61 and concave portions 62 alternately provided in an axial direction thereof. The convex portions 61 and the concave portions 62 extend obliquely with respect to the axial direction of the heat transfer tube 60. In the drawing, the double lines extending obliquely with respect to the axial direction of the heat transfer tube 60 represent convex portions 61 formed to extend obliquely with respect to the axial direction of the heat transfer tube 60.

In the heat transfer tube 60 as described above, when a lead angle which is an angle between the extending direction of the convex portion 61 and the axial direction of the heat transfer tube 60 is excessively small, the time during which the refrigerant stays in the heat transfer tube 60 is shortened, so that the heat transfer performance inside the heat transfer tube 60 is lowered, thereby lowering the heat exchange ability of the heat exchanger 40. Conversely, when the lead angle of the convex portion 61 in the heat transfer tube 60 is excessively large, the convex portion 61 is collapsed to lower the heat transfer performance inside the heat transfer tube 60 or to increase the contact thermal resistance between the heat transfer tube 60 and the fin collar 70, thereby lowering the heat exchange ability.

Therefore, in the heat transfer tube 60 according to the third embodiment, the convex portion 61 is formed such that the ratio of the lead angle of the convex portion 61 to the outer diameter of the heat transfer tube 60 after tube expanding is a valve within a predetermined range. That is, as illustrated in FIG. 8, when the lead angle of the convex portion 61 is denoted by L and the outer diameter of the heat transfer tube 60 after tube expanding is denoted by Do, L/Do is set to be a value within a predetermined range.

Figure 9:
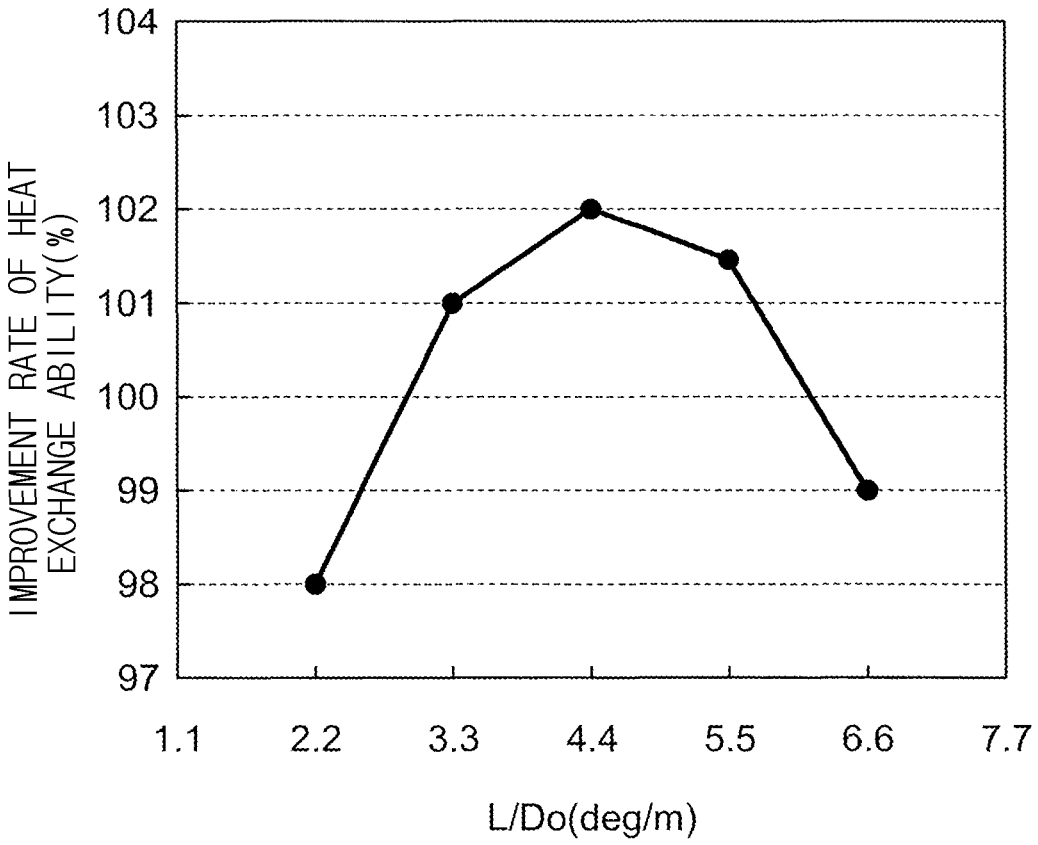
FIG. 9 is a graph illustrating the improvement rate of the heat exchange ability of the heat exchanger according to the ratio of a lead angle of a convex portion of the heat transfer tube to an outer diameter of the heat transfer tube after tube expanding.

FIG. 9 is a graph illustrating the relationship between the ratio (L/Do) of the lead angle of the convex portion 61 to the outer diameter Do of the heat transfer tube 60 after tube expanding and the improvement rate of the heat exchange ability of the heat exchanger 40. In this graph, the heat exchange ability of the heat exchanger 40 having a general specification is set to be 100%.

As illustrated in the drawing, when L/Do is in the range of 3.3 deg./m to 5.5 deg./m, the improvement rate of the heat exchange ability exceeds 100%. Thus, it is appropriate that L/Do is in the range of 3.3 deg./m to 5.5 deg./m.

As such, when the ratio of the lead angle of the convex portion 61 to the outer diameter of the heat transfer tube 60 after tube expanding is set to be a value within the predetermined range, the heat transfer tube 60 according to the third embodiment may suppress a decrease in heat exchange ability due to a decrease in heat transfer performance inside the heat transfer tube 60 or due to an increase in the contact thermal resistance between the heat transfer tube 60 and the fin collar 70.

It will be apparent to those skilled in the art that various modifications and variations may be made from the present disclosure without departing from the spirit and scope of the present disclosure. Accordingly, the modifications or variations are intended to fall within the scope of the appended claims.

The invention claimed is:

1. An air conditioner comprising:

a heat exchanger to perform heat exchange between air and a refrigerant, wherein the heat exchanger includes:

a heat transfer tube through which the refrigerant passes, and a fin including a fin collar with a mounting hole in which the heat transfer tube is installed, wherein the fin collar includes:

an intermediate portion in contact with the heat transfer tube by an expansion of the heat transfer tube, a base portion provided adjacent to the intermediate portion and bent at a first curvature radius, and a distal end located on an opposite side of the intermediate portion from the base portion and bent at a second curvature radius smaller than the first curvature radius.

2. The air conditioner according to claim 1, wherein a ratio (r2/r1) of the second curvature radius r2 to the first curvature radius r1 is in a range of 0.65 to 0.95.

3. The air conditioner according to claim 1, wherein a thickness of the base portion is calculated with an average thickness ((T1+T2)/2) of a first thickness T1 of a first portion in the base portion adjacent to the fin and a second thickness T2 of a second portion in the base portion at an end of the first curvature radius.

4. The air conditioner according to claim 3, wherein a ratio {(T1+T2)/2}/T0 of the average thickness ((T1+T2)/2) of the first thickness T1 and the second thickness T2 to a thickness T0 of the fin is 0.9 or more.

5. The air conditioner according to claim 3, wherein the base portion is gradually thinned from the first portion toward the second portion.

6. The air conditioner according to claim 1, wherein the heat transfer tube includes convex portions and concave portions formed alternately in a circumferential direction on an inner circumferential surface of the heat transfer tube.

7. The air conditioner according to claim 6, wherein:

N numbers of the convex portions and N numbers of the concave portions are formed in the circumferential direction on the inner circumferential surface of the heat transfer tube, the heat transfer tube has a minimum inner diameter Di determined by a most concave portion of the concave portions, and a ratio ((πDi/N)/Do) of a pitch (πDi/N) of the convex portions to an outer diameter Do of the heat transfer tube after tube expanding is in a range of 0.04 to 01.

8. The air conditioner according to claim 1, wherein the heat transfer tube includes convex portions and concave portions formed alternately in an axial direction on an inner circumferential surface of the heat transfer tube.

9. The air conditioner according to claim 8, wherein the convex portions extend obliquely with respect to the axial direction of the heat transfer tube.

10. The air conditioner according to claim 8, wherein a ratio (L/Do) of a lead angle formed by an extending direction of the convex portions and the axial direction of the heat transfer tube to an outer diameter Do of the heat transfer tube is in a range of 3.3 deg./m to 5.5 deg./m.

11. A heat exchanger comprising:

a heat transfer tube through which a refrigerant passes, and a fin including a fin collar with a mounting hole in which the heat transfer tube is installed, wherein the fin collar includes:

an intermediate portion in contact with the heat transfer tube by an expansion of the heat transfer tube, a base portion provided adjacent to the intermediate portion the fin and bent at a first curvature radius, and a distal end located on an opposite side of the intermediate portion from the base portion and bent at a second curvature radius smaller than the first curvature radius.

12. The heat exchanger according to claim 11, wherein a ratio (r2/r1) of the second curvature radius r2 to the first curvature radius r1 is in a range of 0.65 to 0.95.

13. The heat exchanger according to claim 11, wherein a thickness of the base portion is calculated with an average thickness ((T1+T2)/2) of a first thickness T1 of a first portion in the base portion adjacent to the fin, and a second thickness T2 of a second portion in the base portion at an end of the first curvature radius.

14. The heat exchanger according to claim 13, wherein a ratio {(T1+T2)/2}T0 of the average thickness ((T1+T2)/2) of the first thickness T1 and the second thickness T2 to a thickness T0 of the fin is 0.9 or more.

15. The heat exchanger according to claim 13, wherein the base portion is gradually thinned from the first portion toward the second portion.

16. The heat exchanger according to claim 11, wherein the heat transfer tube includes convex portions and concave portions formed alternately in a circumferential direction on an inner circumferential surface of the heat transfer tube.

17. The heat exchanger according to claim 16, wherein:

N numbers of the convex portions and N numbers of the concave portions are formed in the circumferential direction on the inner circumferential surface of the heat transfer tube, the heat transfer tube has a minimum inner diameter Di determined by a most concave portion of the concave portions, and a ratio ((πDi/N)/Do) of a pitch (πDi/N) of the convex portions to an outer diameter Do of the heat transfer tube after tube expanding is in a range of 0.04 to 01.

18. The heat exchanger according to claim 11, wherein the heat transfer tube includes convex portions and concave portions formed alternately in an axial direction on an inner circumferential surface of the heat transfer tube.

19. The heat exchanger according to claim 18, wherein the convex portions extend obliquely with respect to the axial direction of the heat transfer tube.

20. The heat exchanger according to claim 18, wherein a ratio (L/Do) of a lead angle formed by an extending direction of the convex portions and the axial direction of the heat transfer tube to an outer diameter Do of the heat transfer tube is in a range of 3.3 deg./m to 5.5 deg./m.

* * * * *